United States Patent [19]

Allen et al.

[11] Patent Number: 4,713,647

[45] Date of Patent: Dec. 15, 1987

[54] THERMAL VACUUM HEATER ARRAY APPARATUS

[75] Inventors: John E. Allen, Westminster; John D. Glover, Tustin, both of Calif.; Clayton C. Shepherd, Jr., Newport News, Va.

[73] Assignee: The United States of America as represented by the Secretary of the Air Force, Washington, D.C.

[21] Appl. No.: 846,691

[22] Filed: Apr. 1, 1986

[51] Int. Cl.[4] ..... H01C 10/10; H01C 10/16

[52] U.S. Cl. ..... 338/316; 338/283; 219/532

[58] Field of Search ..... 219/532, 536, 542, 546; 338/280, 283, 290, 315–320, 284, 287, 288, 289; 373/128–134

[56] References Cited

U.S. PATENT DOCUMENTS

| | | | |
|---|---|---|---|
| 1,471,913 | 10/1923 | Otis | 219/546 |
| 1,606,765 | 11/1926 | Keene | 338/290 |
| 2,710,905 | 6/1955 | Schramm | 219/532 X |
| 2,921,172 | 1/1960 | Hackman | 219/19 |
| 3,108,171 | 10/1963 | Vary | 219/19 |
| 3,286,117 | 11/1966 | Donlevy | 313/279 |
| 3,395,241 | 7/1968 | Roman | 13/25 |
| 3,798,417 | 3/1974 | Bittner | 219/532 |
| 3,943,333 | 3/1976 | Kokjohn et al. | 219/532 |

*Primary Examiner*—Patrick R. Salce
*Assistant Examiner*—Emanuel Todd
*Attorney, Agent, or Firm*—William Stepanishen; Donald J. Singer

[57] ABSTRACT

An electric resistance heater array having an open metal frame with multiple heater wires of heavy gauge, U-shaped Nichrome wire that are vertically spaced across the panel. The lower vertical portions of the heater wire are encased in ceramic sleeves which insulate the wire from the small apertures in the metal frame that support the wire by its constraints upon side to side and fore to aft movement.

7 Claims, 3 Drawing Figures

THERMAL VACUUM HEATER ARRAY APPARATUS

STATEMENT OF GOVERNMENT INTEREST

The invention described herein may be manufactured and used by or for the Government for governmental purposes without the payment of any royalty thereon.

BACKGROUND OF THE INVENTION

The present invention relates broadly to a heating apparatus, and in particular to an open element thermal vacuum heater array apparatus.

Thermal vacuum testing of the global positioning system (GPS) vehicle requires specific heater array configurations for the shear panels. The thermal transfer requirements result in four arrays on each side of the vehicle. Each array consists of a metal frame containing Nichrome heater wires with spacing between the wires to provide shear panel cooling, when needed, by radiation to the liquid nitrogen ($LN_2$) cooled chamber walls.

The array frames and heater wire lengths which are approximately 24 inches in length, operate in a range of service temperatures between −320F. and 1200F. As a result of the wide temperature operating range, the heater wires are subjected to changes in length that result in a compression force in the heater wire if the wire is secure at both ends. The compression load is relieved by central buckling with a lateral deflection of approximately 1¼ inches. The initial distance between the heater wires and spacecraft louvers is three inches and wire to wire spacing two inches. Several fatigue modes exist that can result in a heater wire breaking in prolonged service and nominal test durations are 30 days per global positioning system (GPS) vehicle. Contact of a live heater wire with the spacecraft can be a catastrophic event.

In the prior art, there are two heater array design approaches which have been in use:

1. Arnold Engineering Development Center (AEDC) uses a complex system of ceramic pulleys and spring tension device to ensure the heater wires are not subjected to compression (see FIG. 1). The application is for a single global positioning system (GPS) vehicle on qualification testing.

2. Block I fixtures (see FIG. 2) used heater wires with fixed end terminations. The heater wire movement was controlled by weaving quartz rods and quartz strings through the vertical wires and securing the ends to the side frames of the array. This was used successfully on 11 Block I vehicles. Three cases of heater wire breakage were reported but without an incident. Both of these systems use relatively light gauge wire. The Arnold Engineering Development Center (AEDC) system has two separate wire runs, back to back, in parallel. The Block I system used three twisted strands.

In general, electrical heater panels have utilized multiple numbers of stiff wires in parallel arrays which may be formed in plane or circular configurations. Some prior art heating apparatus have electrical resistance filaments or elements that utilize a heavy Nichrome wire or rod so that they maintain their form when heated. While it is common to secure the heated filament wire to an insulating support, the reverse procedure of placing an insulator upon the heater wire and supporting the insulator in a metal frame is a also common expedient. However, these prior art methods and techniques suffer from the adverse effects of buckling and elongation of the heating elements. Exemplary in the art of electrical resistance heating apparatus are the following U.S. Patents, which are incorporated herein by reference:

- U.S. Pat. No. 1,471,913 issued to Otis on Oct. 23, 1923;
- U.S. Pat. No. 1,606,765 issued to Keene on Nov. 16, 1926;
- U.S. Pat. No. 2,921,172 issued to Hackman on Jan. 12, 1960;
- U.S. Pat. No. 3,108,171 issued to Vary on Oct. 22, 1963;
- U.S. Pat. No. 3,286,117 issued to Donlevy on Nov. 15, 1966;
- U.S. Pat. No. 3,395,241 issued to Roman on July 30, 1968; and,
- U.S. Pat. No. 3,798,417 issued to Bittner on Mar. 19, 1974.

The Keene reference, U.S. Pat. No. 1,606,765, discloses an electrical wire heater that uses a relatively heavy Nichrome wire or rod to provide a strong heater wire. The heater wires which are formed into a series-parallel array which are loosely held in position by a plurality of sets of staggered pairs of refractory members of electric-insulating material to hold the intermediate parts of the return-bent straight portions in proper operative positions relative to each other.

The Otis reference, U.S. Pat. No. 1,471,913 discloses a heating unit which utilizes a ribbon of suitable resistance allow which is folded or bent in the shape of a hairpin so as to have two substantially parallel portions which are provided with spacing and supporting insulators of such size that the unit when it is assembled may be slipped freely into the tubes of a fire tube boiler.

The Hackman reference, U.S. Pat. No. 2,921,172 relates to open coil heating units which utilize a long helical coil of resistance wire that is supported in an open or exposed manner by a grille or lattice type metal frame having spaced apart electrical insulators through which the resistance coil extends.

The Vary reference, U.S. Pat. No. 3,108,171 illustrates a radiant heater having formed filaments wherein a plurality of refractory metal strips are arranged in a generally circular array and each filament is curved about its major centerline to form a dihedral angle for structural stability.

The Donlevy reference, U.S. Pat. No. 3,286,117 discloses a filament support which has an elongated bore with a diameter only slightly larger than that of the filament and a length many times the filament diameter.

The Roman reference, U.S. Pat. No. 3,395,241, discloses a heating element assembly comprising a plurality of said heating element rod units interconnected by their bridging elements in a squirrel cage formation with the resistance rods electrically connected in series, and spaced refractory mounts supporting the end portions of the resistance rods.

The Bittner reference, U.S. Pat. No. 3,798,417, describes a heating element assembly with a plurality of elements, with each element being formed by linear reaches or strips of a foil-like resistive conductor immobilized along the length of a supporting rod by adjustable insulating bars at substantially regular intervals. These immobilizing insulating bars prevent axial or rotational movement of the conductive strips of foil to ensure that separate conductors neither short together nor come in contact with the supporting structure or the assembly's containment.

SUMMARY OF THE INVENTION

The present invention utilizes an electric resistance heater array which is arranged in an open metal frame having multiple heater wires that are vertically spaced across the panel. Each of the multiple heater wires comprise a heavy guage, U-shaped Nichrome wire with sufficient stiffness to be considered a light rod. Additionally, each individual heater wire is formed in an U-shape to provide an additional stiffness characteristic. The lower vertical portions of each heater wire is encased in a ceramic support sleeves to insulate the heater wires from the lower metallic support frame. The lower metallic support frame has small aperatures therein to support the heater wires and to limit the amount side to side and fore to aft movement of the heater wires. An electrical resistance heater apparatus of this configuration essentially eliminates the common heater failure modes that are due to wires breaking under compression load buckling.

It is one object of the present invention, therefore, to provide an improved thermal vacuum heater array apparatus.

It is another object of the invention to provide an improved thermal vacuum heater array apparatus that utilizes a self-supporting Nichrome heater wire of substantially heavy gauge.

It is another object of the invention to provide an improved thermal vacuum heater array apparatus wherein each heater wire element is substantially U-shaped.

It is another object of the invention to provide an improved thermal vacuum heater array apparatus wherein the lower portions of each U-shaped heater wire is encased in ceramic sleeve to prevent electrical contact with the metallic support frame.

It is another object of the invention to provide an improved thermal vacuum array apparatus wherein rectangular apertures in the support frame limit the heater wire travel.

These and other advantages, objects and features of the invention will become more apparent after considering the following description taken in conjunction with the illustrative embodiment in the accompanying drawings.

DESCRIPTION OF THE PREFERRED EMBODIMENT

Figure 1:
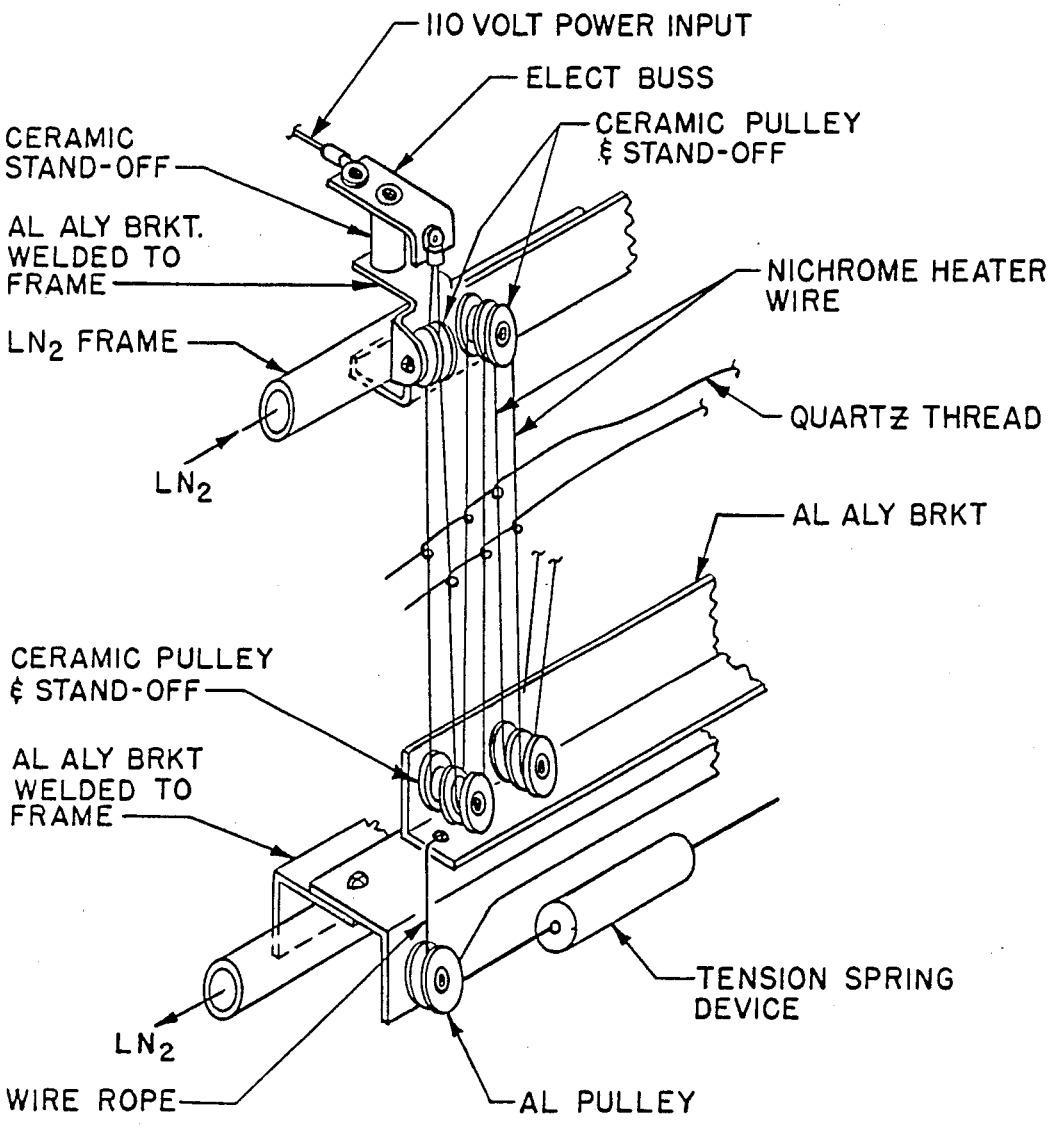
FIG. 1 PRIOR ART
FIG. 1 is a perspective view of a prior art Arnold Engineering Development Center (AEDC) heater system.
Figure 2:
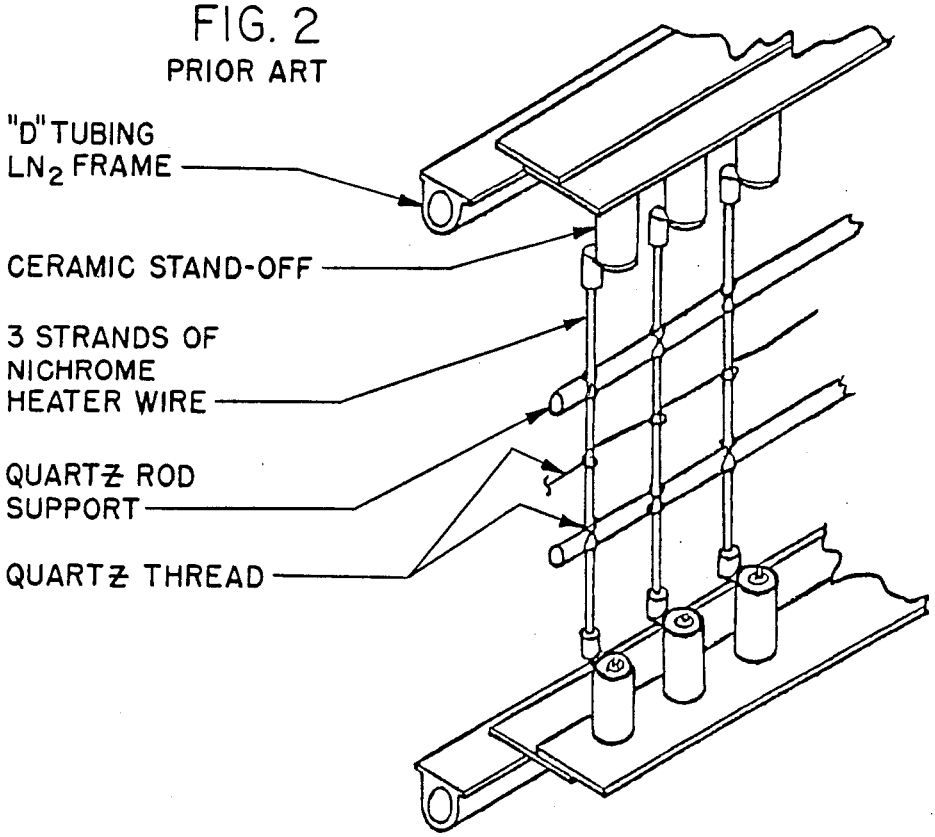
FIG. 2 PRIOR ART
FIG. 2 is a perspective view of a prior art block I heater system, and, FIG. 3 is a perspective view of a block II thermal vacuum heater array apparatus according to the present invention.

Thermal vacuum heater arrays to perform simulated space testing of the global positioning system vehicle require particular operating characteristics and ranges. Listed below are the main testing parameters which are achieved by the prior art heater arrays. The prior art heater arrays (FIGS. 1 and 2) utilizes a series of uninsulated resistance heater wires in conjunction with mechanical systems for positioning and maintaining heater wire tension over the anticipated range of wire service temperatures. A more detailed description is:

2 Shear Panel Assemblies (each approximately $3\frac{1}{2}\times5\frac{1}{2}$ ft.) mounted in $LN_2$ cooled frames, adapted to the AEDC fixture with the test vehicle in a horizontal position.

8 Isolated heating zones, 4 zones/panel. Each panel is different and each panel uses two different size zones.

24 Heat Assemblies—3 in each zone, 12 in each panel. On each panel—6 assemblies are 8 strand, 6 are 12 strand but with different dimensions for each panel.

24 Spring tension devices (1 for each heater assemblies) with two pulleys and attachment leads on each.

312 Pulleys (48 on tension assemblies, 264 on heater assemblies).

880 feet of heater wire, 20 gauge Nichrome.

48 Heater wires, two in parallel on each heater and tension assemblies. Each heater wire is $\approx$240 inches long on 12 strand assemblies and $\approx$200 inches long on 8 strand assemblies.

1700F. anticipated heater wire temperature. (This temperature is based on calculations for 1 sun input to 100F. specimen. The drawings also require 1800F. ceramic insulators and pulleys).

In general, a quartz thread is strung perpendicular to the heater wire runs, side to side of each heater assemblies, approximately 3-inch spacing, approximately two inches from both top and bottom heater wires. This appears to be for heater wire protection.

In addition, the following design parameters were also required:

1. The $LN_2$ cooled frame requires make and break of fluid connections for assembly. The basic frame configuration is not applicable to Seal Beach.
2. The pulleys for distribution of heater wire tension should be ineffective. After two wires of 20 gauge Nichrome are wrapped around a small diameter pulley—both should be immobilized. The pulley bearing pin is also supported on only one end.
3. Obtaining uniform tension in two parallel wires is not practical (see #2 above). It is anticipated the tension device will cause the wires to yeild to uniform length at elevated wire temperatures. It is also expected the yield will not be uniform and will result in local non-uniformity of electrical resistance.
4. In conjunction with continued handling and service, the individual heater wires will tend to get locally corroded, bent, and stretched (see #3 above), creating local areas of higher electrical resistance. These areas in turn will produce a locally higher temperature and be subject to preferential oxidation on ambient checkouts. The individual heater wires which are approximately ten feet long, would increase the probability of local conductor failure on prolonged service.
5. Any open, readily accessible, electrical circuit must be considered hazardous.
   a. Employee hazards when primary circuit control is remote from the work area.
   b. Close proximity to a sensitive spacecraft with possible in-test local corona or broken heater wire.
6. The quartz thread assembly provides little or no control or protection for the heater wires.

7. Each of the 24 spring tension devices could require in-tests protective heating. This would stabilize spring constants, and, if martensitic steel, protect the spring from embrittlement at cryo-temperatures.
8. Prolonged operation of an open filament array (such as AEDC design) would require frequent detailed inspection and periodic disassembly and heater wire replacement by chamber technicians. The heater wire assemblies which are not commercially available and are not modular units, require four different configurations.
9. The AEDC heater concept will require an appreciable quantity of liquid nitrogen ($LN_2$) compared to other heater concepts.

Figure 3:
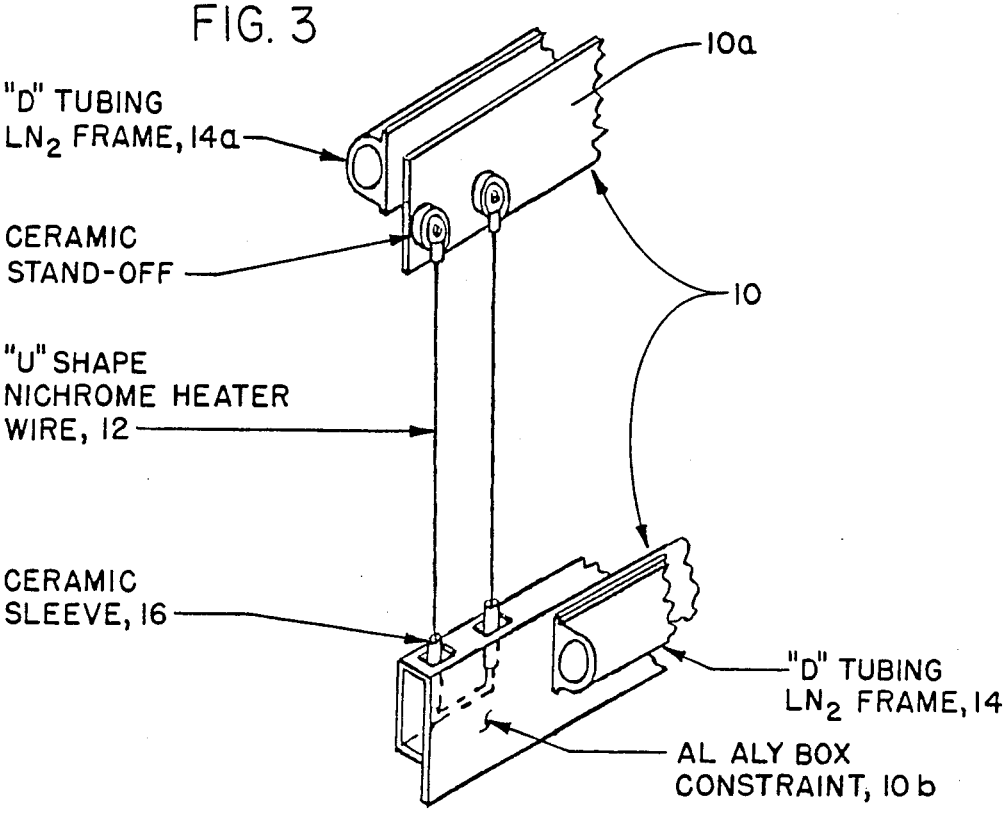

Referring now to FIG. 3, there is shown a thermal vacuum heater array apparatus. A metallic support frame 10 which comprises an upper frame member 10*a* and a lower frame member 10*b* provides support for the electrical resistance heater wire 12. It should be well understood that the support frame 10 which is shown in partial view, comprises a support structure that will contain a plurality of heater wires. In order to achieve the cooling requirements of the thermal vacuum heater array apparatus, cooling tubes 14 are attached in a thermally efficient heat transfer manner to the upper and lower frame members 10*a*, 10*b*. The cooling tubes 14 may comprise D tubing or any other substantially suitable liquid cnducting member. The cooling medium which is supplied to the cooling tubes 14 in the present example, is liquid nitrogen, however, any suitable cooling medium may be utilized.

The heater wires which are used in the thermal vacuum heater array apparatus are 16 gauge Nichrome. This provides a heater element of sufficient cross section and stiffness such that it can be treated as a light rod instead of flexible wire. In order to avoid heater wire compression loads which can occur during the thermal swings in testing, the heater wire segments are formed in an exaggerated U-shape. The electrical connections to the heater element are made at the two upper ends of the wire. The plurality of heater wires are electrically isolated from the upper support member. The lower end of the heater wire is held in slots in a small box type constraint bar that comprises the lower frame member 10*b*. The parts of the heater wire which pass through the box constraint, are encased in a ceramic sleeve 16 to prevent electrical contact with the lower frame member 10*b*. The openings in the box constraint member are substantially rectangular in shape and only slightly larger than the ceramic sleeve 16. These openings allow the heater wire 12 to have free vertical movement but limited side to side or fore to aft movement.

Although the invention has been described with reference to a particular embodiment, it will be understood to those skilled in the art that the invention is capable of a variety of alternative embodiments within the spirit and scope of the appended claims.

What is claimed is:

1. A thermal vacuum heater array apparatus comprising in combination:

a support frame having an upper and lower support member, a plurality of heater wires attached to said upper support member, said plurality of heater wires being electrically isolated from said upper support member, said plurality of heater wires having a predetermined diameter to prevent buckling, each wire of said plurality of heater wires being linearly positioned with respect to each other along said upper support member, each wire being substantially U-shaped, both ends of wire being attached to said upper support member, the U-shape portion of said wire passing through openings in said lower support member, said U-shape portion of said wire including an electrical isolation means to prevent electrical contact between said wire and said lower support member, and means for cooling operatively connected to said support frame for cooling said heater array apparatus.

2. A heater array apparatus as described in claim 1 wherein said cooling means comprises in combination:

first and second cooling members which are respectively attached to said upper and lower support members, said first and second cooling members containing transfer channels for conducting a cooling medium.

3. A heater array apparatus as described in claim 2 wherein said openings in said lower support member are substantially rectangular in shape and slightly larger than said wire.

4. A heater array apparatus as described in claim 2 wherein said predetermined diameter of said plurality of heater wires is 16 guage.

5. A heater array apparatus as described in claim 2 wherein said openings in said lower support members allows free vertical movement of said wires but restricts the side to side and fore to aft movement.

6. A heater array apparatus as described in claim 2 wherein said electrical isolation means comprises a ceramic sleeve.

7. A heater array apparatus as described in claim 2 wherein said cooling medium comprises liquid nitrogen.

* * * * *